US009399562B2

(12) United States Patent
Terry et al.

(10) Patent No.: US 9,399,562 B2
(45) Date of Patent: Jul. 26, 2016

(54) ELEVATOR SPEED AND POSITION DETECTION SYSTEM USING AN OPTICAL SENSOR

(75) Inventors: Harold Terry, New Hartford, CT (US); Leandre Adifon, Mooresville, NC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 699 days.

(21) Appl. No.: 13/697,935

(22) PCT Filed: Jul. 12, 2010

(86) PCT No.: PCT/US2010/041710

§ 371 (c)(1), (2), (4) Date: May 20, 2013

(87) PCT Pub. No.: WO2012/008944

PCT Pub. Date: Jan. 19, 2012

(65) Prior Publication Data

US 2013/0228400 A1 Sep. 5, 2013

(51) Int. Cl.
*B66B 1/34* (2006.01)
*B66B 1/28* (2006.01)

(52) U.S. Cl.
CPC ..... *B66B 1/285* (2013.01); *B66B 1/3492* (2013.01)

(58) Field of Classification Search
CPC ..... B66B 1/285; B66B 1/3492
USPC ..... 187/247, 316, 317, 391, 393, 394
See application file for complete search history.

(56) References Cited

U.S. PATENT DOCUMENTS 4,134,476 A * 1/1979 Zolnerovich, Jr. .... B66B 1/3492 187/394
4,494,628 A * 1/1985 Uherek ..... B66B 1/3492 187/291
5,102,226 A 4/1992 Yoshimura et al.
5,644,111 A * 7/1997 Cerny ..... B66B 5/005 187/280
5,821,477 A * 10/1998 Gerstenkorn ..... B66B 1/3492 187/316
5,889,239 A * 3/1999 Blackaby ..... B66B 1/40 187/391
6,079,521 A 6/2000 Schönauer et al.

(Continued)

FOREIGN PATENT DOCUMENTS

CN 1201998 A 9/2003
EP 1286905 3/2003

(Continued)

OTHER PUBLICATIONS

First office action mailed Dec. 20, 2013 in corresponding Chinese Application No. 201080068009.6.

(Continued)

*Primary Examiner* — Anthony Salata
(74) *Attorney, Agent, or Firm* — Cantor Colburn LLP

(57) ABSTRACT

An elevator associated within a hoistway and having a speed and position detection system. The elevator may include an elevator component associated within the hoistway, an optical sensor associated within the hoistway, an object associated within the hoistway in such a manner to be aligned in a path of the optical sensor, and a processor operatively coupled to the optical sensor. The optical sensor may be capable of emitting a signal and receiving a reflected signal of the emitted signal. The object may have surface features that may reflect the signal. The processor may be capable of processing the reflected signal to provide an output indicative of a speed and position of the elevator component.

18 Claims, 5 Drawing Sheets

(56) References Cited

U.S. PATENT DOCUMENTS

| | | | | |
|---|---|---|---|---|
| 6,128,116 | A | 10/2000 | Dobler et al. | |
| 6,427,809 | B2 | 8/2002 | Bammert | |
| 6,437,315 | B1 | 8/2002 | Skalski | |
| 6,484,849 | B2 | 11/2002 | Vecchiotti et al. | |
| 6,649,904 | B2 | 11/2003 | Hayashi et al. | |
| 6,723,980 | B2 | 4/2004 | Lee | |
| 6,945,363 | B2 | 9/2005 | Angst et al. | |
| 6,988,594 | B2 * | 1/2006 | Deplazes | B66B 5/0031 187/316 |
| 7,233,389 | B2 | 6/2007 | Rastegar et al. | |
| 7,379,049 | B2 | 5/2008 | Hengstler et al. | |
| 7,540,357 | B2 * | 6/2009 | Finn | B66B 1/3492 187/394 |
| 7,588,127 | B2 * | 9/2009 | Shiratsuki | 187/391 |
| 7,597,176 | B2 * | 10/2009 | Zaharia | B66B 1/3492 187/394 |
| 7,600,613 | B2 * | 10/2009 | Kang | G06K 7/10079 187/283 |
| 7,669,698 | B2 * | 3/2010 | Jahkonen | B66B 1/3492 187/247 |
| 7,954,606 | B2 * | 6/2011 | Tinone | B66B 5/005 187/384 |
| 8,857,572 | B2 * | 10/2014 | Leutenegger | B66B 1/3492 187/316 |
| 8,960,376 | B2 * | 2/2015 | De Coi | B66B 1/3492 187/247 |
| 2002/0057438 | A1 | 5/2002 | Decker | |
| 2004/0207836 | A1 | 10/2004 | Chhibber et al. | |
| 2005/0046821 | A1 | 3/2005 | Hanson et al. | |
| 2006/0092419 | A1 | 5/2006 | Gui | |
| 2006/0226346 | A1 | 10/2006 | Bieber et al. | |
| 2008/0012850 | A1 | 1/2008 | Keating, III | |
| 2008/0156591 | A1 * | 7/2008 | Tracey | B66B 1/40 187/394 |
| 2008/0202862 | A1 | 8/2008 | Dudde et al. | |
| 2009/0016646 | A1 | 1/2009 | Chen et al. | |
| 2009/0190120 | A1 | 7/2009 | Wustefeld | |
| 2009/0231582 | A1 | 9/2009 | Aebischer et al. | |

FOREIGN PATENT DOCUMENTS

| | | | |
|---|---|---|---|
| EP | 1345444 | | 9/2003 |
| EP | 1362000 | | 4/2009 |
| FR | 2822144 | | 9/2002 |
| GB | 2 425 831 | | 5/2006 |
| JP | H06127851 | A | 5/1994 |
| JP | H07157220 | A | 6/1995 |
| JP | H08188364 | A | 7/1996 |
| JP | H09124238 | A | 5/1997 |
| JP | H1081475 | A | 3/1998 |
| JP | 2008508155 | A | 3/2008 |
| JP | 2011037578 | A | 2/2011 |
| KR | 10200591726 | A | 9/2005 |
| KR | 20080089673 | A | 10/2008 |
| WO | WO-2005/009882 | A1 | 2/2005 |
| WO | WO-2007/039750 | A2 | 4/2007 |
| WO | WO-2008/077980 | A1 | 7/2008 |
| WO | WO-2009/071417 | A1 | 6/2009 |
| WO | WO-2010/006197 | A1 | 1/2010 |

OTHER PUBLICATIONS

First office action mailed Mar. 14, 2014 in corresponding Korean Application No. 10-2013-7003316.

First office action mailed Mar. 27, 2014 in corresponding Japanese Application No. 2013-519633.

* cited by examiner

ELEVATOR SPEED AND POSITION DETECTION SYSTEM USING AN OPTICAL SENSOR

CROSS-REFERENCE TO RELATED APPLICATIONS

This application is a U.S. national stage filing under 35 USC §371 of International Patent Application No. PCT/US2010/041710, filed on Jul. 12, 2010.

FIELD OF THE DISCLOSURE

The present disclosure generally relates to elevators, and, in particular, relates to a speed and position detection system for an elevator.

BACKGROUND OF THE DISCLOSURE

In modern society, elevators have become ubiquitous machines for transporting people and cargo through buildings of multiple stories. As elevators are operated continually throughout the day making frequent stops at various floor levels, the safety monitoring system of an elevator plays an important role in ensuring reliable operation of the elevator.

Elevator safety codes require, among other things, that the speed of the elevator be checked as it approaches a terminal landing to ensure that the speed can be reduced to a reasonable safe speed as it approaches the landing. One current method widely adopted is the use of switches and cams to determine if the elevator is slowing down. However, the installation of the switches and cams is quite costly, not to mention the significant maintenance these switches and cams require.

Another method currently used to determine speed of the elevator is by utilizing an elevator positioning system. Many current elevator positioning systems use elevator car position information, which is derived from encoders and/or switches, to determine not only the position of the elevator car, but also the speed of the elevator car. The installation of such positioning systems is also quite costly.

In light of the foregoing, improvements continue to be sought for a cost effective system to determine the speed and position of an elevator car.

SUMMARY OF THE DISCLOSURE

In accordance with one aspect of the disclosure, an elevator associated within a hoistway and having a speed and position detection system is disclosed. The elevator may include an elevator component associated within the hoistway, an optical sensor associated within the hoistway, an object associated within the hoistway in such a manner to be aligned in a path of the optical sensor, and a processor operatively coupled to the optical sensor. The optical sensor may be capable of emitting a signal and receiving a reflected signal of the emitted signal. The object may have surface features upon which the signal may be reflected. The processor may be capable of processing the reflected signal to provide an output indicative of a speed and position of the elevator component.

In accordance with another aspect of the disclosure, an elevator with a speed and position detection system is disclosed. The elevator may include an elevator car, an optical sensor operatively coupled to the elevator car, a static object associated with the optical sensor in such a manner to, be aligned in a path of the optical sensor, and a processor operatively coupled to the optical sensor. The optical sensor may be capable of emitting a signal and receiving a reflected signal of the emitted signal. The static object may have surface features upon which the signal is reflected. The processor may be capable of processing the reflected signal to provide an output indicative of a speed and position of the elevator car.

In accordance with yet another aspect of the disclosure, a method for detecting speed and position of an elevator component is disclosed. The method may include providing an optical sensor capable of emitting and receiving signals; providing an object aligned in a path of the optical sensor and capable of reflecting signals; providing a processor operatively coupled to the optical sensor and capable of processing reflected signals received by the optical sensor; emitting a signal from the optical sensor onto the object; receiving a reflected signal off of the object; processing the reflected signal received by the optical sensor; and providing an output indicative of a speed and position of the elevator component.

These and other aspects of this disclosure will become more readily apparent upon reading the following detailed description when taken in conjunction with the accompanying drawings.

Figure 1:
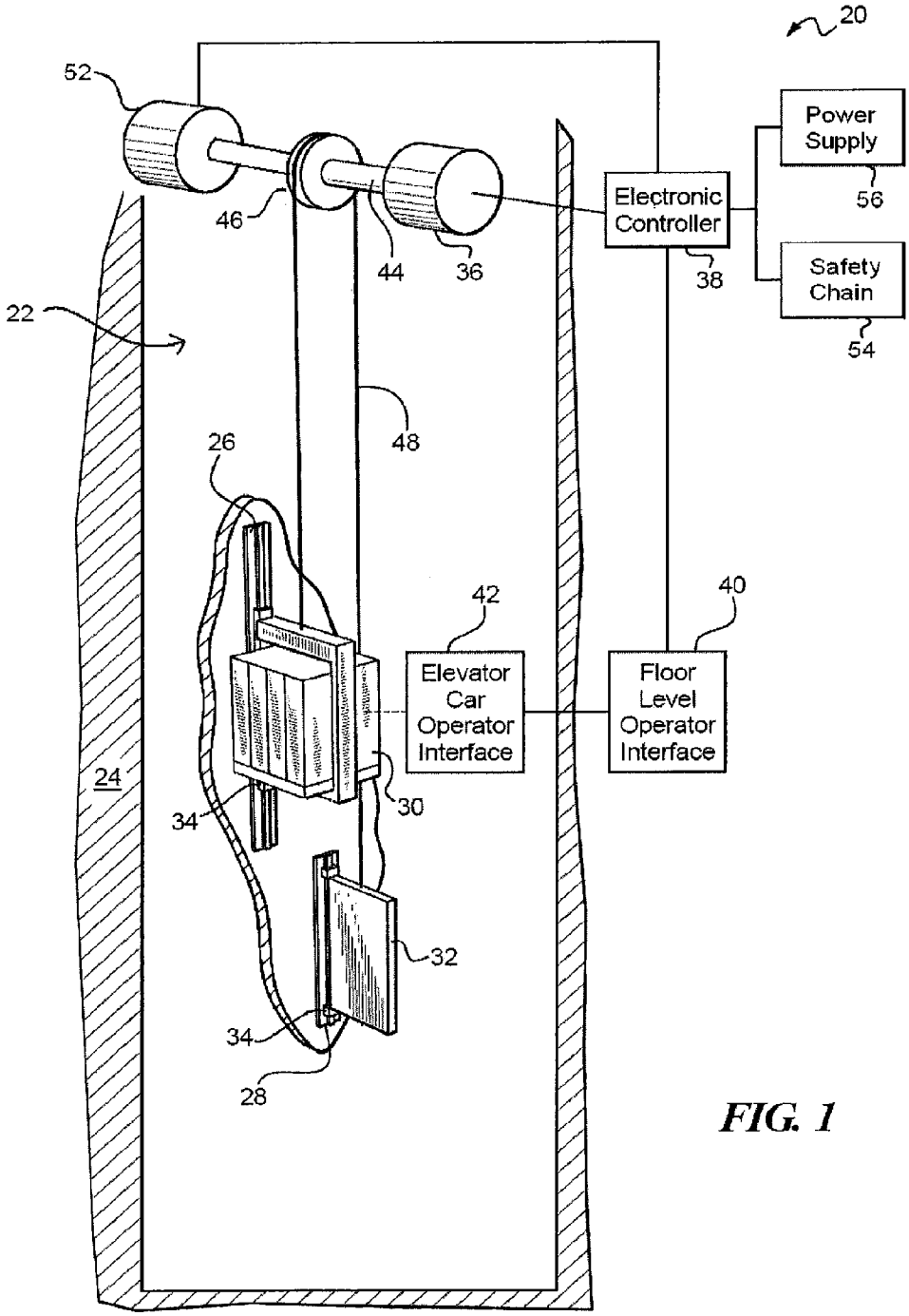
FIG. 1 is an embodiment of an elevator constructed in accordance with the teachings of the disclosure.

While the present disclosure is susceptible to various modifications and alternative constructions, certain illustrative embodiments thereof have been shown in the drawings and will be described below in detail. It should be understood, however, that there is no intention to be limited to the specific forms disclosed, but on the contrary, the intention is to cover all modifications, alternative constructions, and equivalents falling within the spirit and scope of the present disclosure.

DETAILED DESCRIPTION OF THE DISCLOSURE

Referring now to FIG. 1, an elevator system 20 is shown in schematic fashion. It is to be understood that the version of the elevator system 20 shown in FIG. 1 is for illustrative purposes only and to present background for the various components of a general elevator system.

As shown in FIG. 1, the elevator system 20 may include a hoistway 22 provided vertically within a multi-story building 24. Typically, the hoistway 22 could be a hollow shaft provided within a central portion of the building 24 with multiple hoistways being provided if the building is of sufficient size and includes multiple elevators. Extending substantially the length of the hoistway 22 may be rails 26 and 28. An elevator car 30 may be slidably mounted on a pair of rails 26 (only one rail 26 shown in FIG. 1 for clarity) and a counterweight 32 may be slidably mounted on a pair of rails 28 (only one rail 28 shown in FIG. 1 for clarity). While not depicted in detail in FIG. 1, one of ordinary skill in the art will understand that both the car 30 and counterweight 32 could include roller mounts 34, bearings, or the like for smooth motion along the rails 26 and 28. The roller mounts, bearings, or the like may also be slidably mounted to the rails 26 and 28 in a secure fashion.

In order to move the car 30 and thus the passengers and/or cargo loaded thereon, a motor 36 may be provided typically at the top of hoistway 22. Electrically coupled to the motor 36 may be an electronic controller 38 which in turn may be electrically coupled to a plurality of operator interfaces 40 provided on each floor to call the elevator car 30, as well as operator interfaces 42 provided on each car 30 to allow the passengers thereof to dictate the direction of the car 30. A safety chain circuit 54, as well as a power supply 56, may also be electrically coupled to the electronic controller 38. Mechanically extending from the motor 36 may be a drive shaft 44, which in turn may be operatively coupled to a traction sheave 46, and further may extend to operatively couple to a braking system 52. The braking system 52 may also be electrically coupled to the electronic controller 38. Trained around the sheave 46 may be e tension member 48, such as a round rope or a flat belt. The tension member 48 may be in turn operatively coupled to counterweight 32 and car 30 in any suitable roping arrangement. Of course, multiple different embodiments or arrangements of these components are possible with a typical system including multiple tension members 48 as well as various arrangements for the motor and the sheaves of the elevator system 20.

Figure 2:
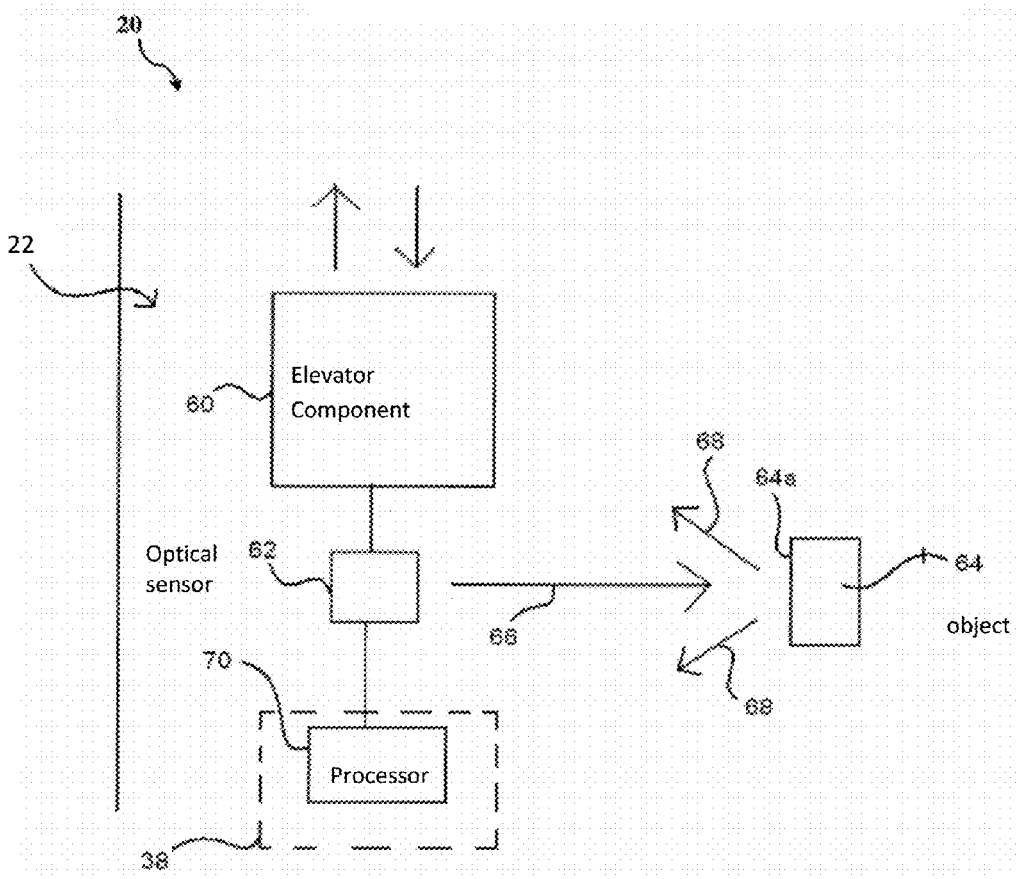
FIG. 2 is an embodiment of a speed and position detection system for an elevator constructed in accordance with the teachings of the disclosure.

In FIG. 2, a speed and position detection system for the elevator system 20 is disclosed. The speed and position detection system may include an optical sensor 62, an object 64, and a processor 70. The optical sensor 62 may be operatively coupled to an elevator component 60 such as, but not limited to, the elevator car 30. The optical sensor 62 may be capable of emitting and receiving signals. The object 64 may be positioned within the hoistway 22 in such a manner to be aligned in a path of the optical sensor 62, and may have surface features 64*a*, which may reflect the signals emitted by the optical sensor 62. The processor 70 may be integrated within the electronic controller 38 and operatively coupled to the optical sensor 62. It should be understood that the processor 70 does not have to be designed within the electronic controller 38, and that it may be designed as a free-standing circuit on its own or incorporated within any other component within the elevator 20. Furthermore, the processor 70 may be capable of processing signals received from the optical sensor 62 and producing an output indicating a speed and position of the elevator component 60.

As the elevator component 60 moves within the hoistway 22, the optical sensor 62 may emit a signal 66 onto the object 64. The signal 66 may then be reflected off of the surface features 64*a* of the object 64. A reflected signal 68 may then be received by the optical sensor 62 at a certain time delay and angle. In one exemplary embodiment, the time delay and angle may then be used by the processor 70 to process the speed and position of the elevator component 60. It should be understood that other information from the reflected signal 68, as known by one skilled in the art, may be used by the processor 70 for providing a speed and position output.

In one exemplary embodiment, the optical sensor may emit a light signal 66, which may be produced by a light-emitting diode (LED) or a laser diode. The use of LEDs and lasers may allow for a sensing range of at least a few millimeters, while at the same time being applicable for longer range measurements. Optical sensors that utilize LEDs or laser may be an inexpensive accurate solution in measuring the speed and position of a moving object, especially in an elevator.

Figure 3:
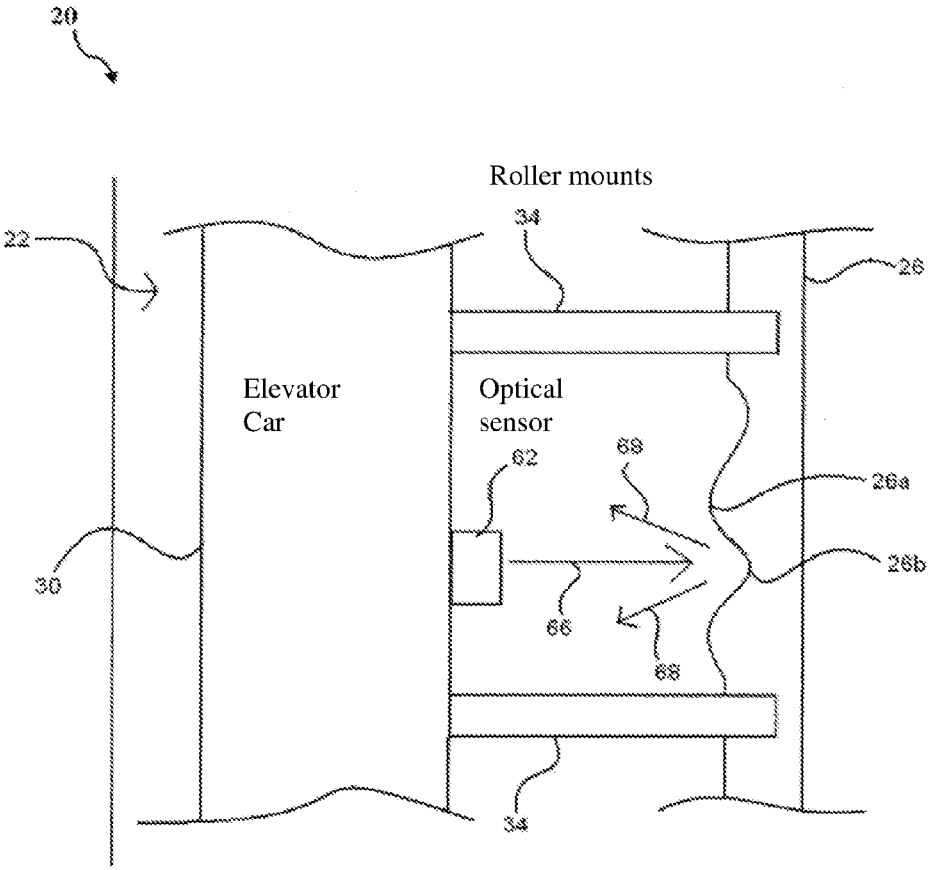
FIG. 3 is another embodiment of a speed and position detection system for an elevator constructed in accordance with the teachings of the disclosure.

Referring now to FIG. 3, in one embodiment, the optical sensor 62 may be operatively coupled to the elevator car 30 in such a manner to align with the rail 26 extending within the hoistway 22. The rail 26 may have a limited length and may have imperfections on its surface such as slight protrusions 26*a* and indentations 26*b* (which are exaggerated in FIG. 3 for illustrative purposes). As the elevator car 30 slidably moves along the rail 26, the optical sensor 62 may emit signals 66 onto the rail 26. The reflected signals 68 off protrusions and indentations 26*a*, 26*b* on the rail 26, or off rail joints (not shown), may be used by the processor 70 to determine the speed and position of the elevator car 30. For example, a reflected signal 68 off a rail joint, or a protrusion or indentation 26*a*, 26*b* on the rail 26, may be received by the optical sensor 62 and stored by the processor 70. The processor 70 may at this point process the reflected signal 68 to determine current position and speed of the elevator car 30. In one exemplary embodiment, the current position may be obtained by referencing a pre-scan of the rail 26 identifying all the locations of the rail joints, protrusions and indentations 26*a*, 26*b*, which may be stored in the memory of the processor 70. The speed of the elevator car 30 may be determined by the time delay and angle between emitting the signal 66 and receiving the reflected signal 68.

As the elevator car 30 continues to move along the rail 26, a second reflected signal 68 off a second protrusion or indentation 26*a*, 26*b* on the rail 26 may be received by the optical sensor 62 and stored by the processor 70. At this point, the processor 70 may process the second reflected signal 68 to determine current position and speed of the elevator car 30 as before. An alternative may be to use the time delay between the two reflected signals 68 stored in the processor 70 to determine the speed and position of the elevator car 30.

Figure 4:
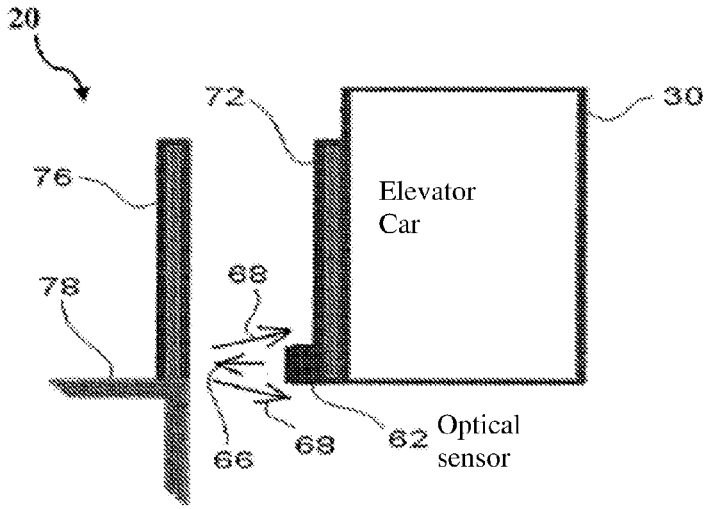
FIG. 4 is yet another embodiment of a speed and position detection system for an elevator constructed in accordance with the teachings of the disclosure.

In another embodiment shown in FIG. 4, the optical sensor 62 may be operatively coupled to the elevator car 30 in such a manner to align with an elevator door 72. As the elevator car 30 approaches a floor level 78, the optical sensor 62 may emit signals 66 onto a hoistway door 76. Reflected signals 68 off of the hoistway door 76 may be received by the optical sensor 62 and further processed by the processor 70 to determine the exact location of the elevator door 72.

Figure 5:
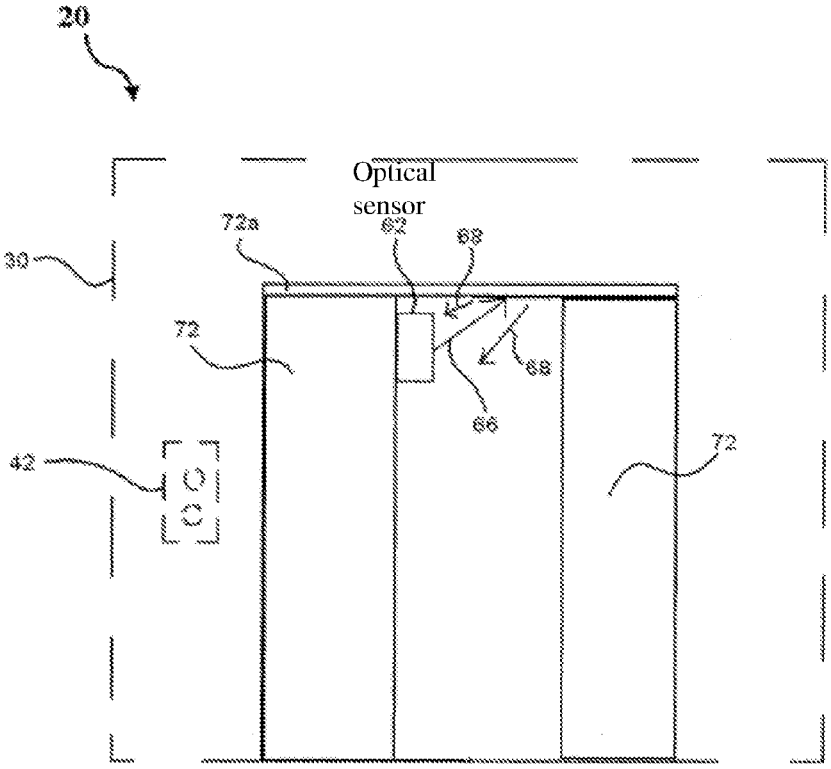
FIG. 5 is yet another embodiment of a speed and position detection system for an elevator constructed in accordance with the teachings of the disclosure.

In another embodiment shown in FIG. 5, the optical sensor 62 may be operatively coupled to the elevator car door 72 in such a manner to align with an elevator door track 72*a*. As the elevator door 72 opens and closes, the optical sensor 62 may emit signals 66 onto the elevator door track 72*a*. Reflected signals 68 off the elevator door track 72*a* may be received by the optical sensor 62 and further processed by the processor 70 to determine the speed and position of the elevator door 72.

Figure 6:
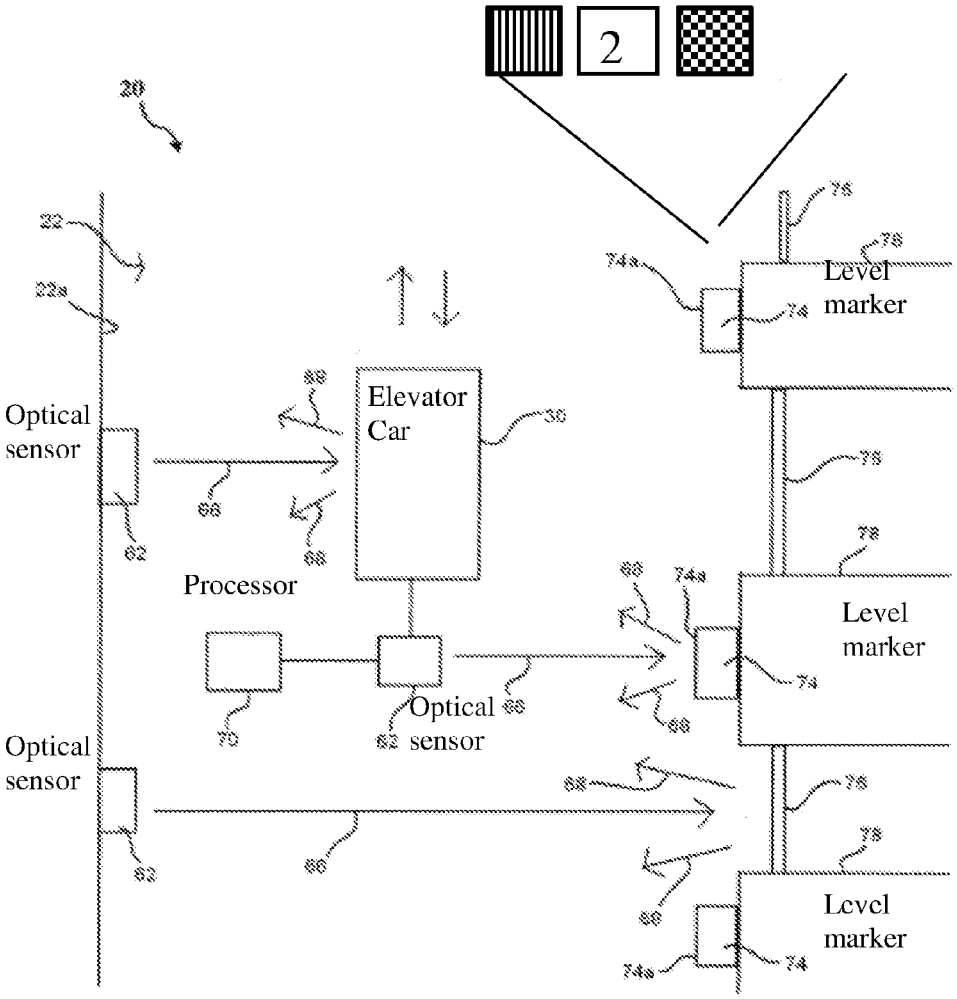
FIG. 6 is yet another embodiment of a speed and position detection system for an elevator constructed in accordance with the teachings of the disclosure.

In yet another embodiment shown in FIG. 6, optical sensors 62 may be operatively coupled to the elevator car 30 and a wall 22*a* of the hoistway 22. Level markers 74 having surface features 74*a* may be operatively coupled within the hoistway 22 near each landing level 78. The surface features 74*a* may be lines identifying each landing level 78 such as, but not limited to, bar code markings, numbers, and any optically detectable lines having various shapes and orientations. For instance, at level "3", the lines 74*a* on the level marker 74 may depict the number "3", bar code markings representing the number "3", or any other shape and orientation which the processor 70 may identify as the number "3". Each landing level 78 may also have a hoistway door 76 keeping passengers from entering the hoistway 22 unless an elevator car 30 is present.

As the elevator car 30 moves vertically within the hoistway 22, the optical sensor 62 coupled to the elevator car 30 may emit a signal 66 onto each level marker 74 it passes. Reflected signals 68 off the surface features 74*a* of each level marker 74 may then be received by the optical sensor 62 and stored by the processor 70. In one exemplary embodiment, the processor 70 may determine the position of the elevator car 30 from the reflected signals 68 off the surface features 74*a* of each level marker 74, as well as the speed of the elevator car 30 from the time delay between when the sensor 62 passes the first level marker 74 to when the optical sensor 62 passes a second level marker 74. The optical sensors 62 coupled to the wall 22*a* of the hoistway 22 may be aligned to be in a path of each hoistway door 76. These optical sensors 62 may detect if the hoistway door 76 may be present or absent. If the hoistway, door 76 is absent, the processor 70 may determine if the elevator car 30 is present from the reflected signals 68 received by the optical sensors 62. If the elevator car 30 is absent as well, then the processor 70 may trigger the safety chain 54 indicating detection of an unsafe condition.

In light of the foregoing, it can be seen that the present disclosure sets forth a speed and position detection system for an elevator. Elevators are continually used to transport passengers from one level to the next. The speed and position detection system of the elevator may be relied upon to ensure that an elevator car may be operating at a safe and reliable speed, and that the elevator car may be at a desired position. Furthermore, the speed and position detection system of the elevator may ensure other safety codes and regulations are being met such as, but not limited to, the presence or absence of a hoistway door. The use of optical sensors, which may utilize LEDs and laser diodes to emit signals, may be an inexpensive and reliable solution to detecting the speed and position of an elevator component. Optical sensors may be relied upon for both short range and longer range measurements, making them versatile as well.

While only certain embodiments have been set forth, alternatives and modifications will be apparent from the above description to those skilled in the art. These and other alternatives are considered equivalents and within the spirit and scope of this disclosure.

What is claimed is:

1. An elevator system including a hoistway having a width and a speed and position detection system, comprising:

an elevator component associated within the hoistway;

an optical sensor associated within the hoistway, and capable of emitting a signal and receiving a reflected signal of the emitted signal;

an object positioned within the hoistway in such a manner to be aligned in a path of the optical sensor and having surface features; and a processor operatively coupled to the optical sensor and capable of processing the reflected signal to provide an output indicative of a speed and position of the elevator component, the processor using a time delay between emitting the signal and receiving the reflected signal and an angle between the signal and the reflected signal to determine the speed and position of the elevator component.

2. The elevator system of claim 1, wherein the optical sensor is operatively coupled to the elevator component and the object is statically fixed within the hoistway such that as the elevator component moves, the reflected signal off the object is used to process the speed and position of the elevator component.

3. The elevator system of claim 1, wherein the optical sensor comprises at least one of a light-emitting diode and a laser diode.

4. The elevator system of claim 1, wherein the optical sensor has a range of sensing that is between a few millimeters and the width of the hoistway.

5. The elevator system of claim 1, wherein the elevator component comprises at least one of an elevator car and an elevator door.

6. The elevator system of claim 5, wherein the optical sensor is operatively coupled to the elevator car, the object is a rail extending within the hoistway, and the surface features are protrusions and indentations on the rail such that as the elevator car slidably moves along the rail, and the optical sensor emits the signal onto the rail, the reflected signals off the protrusions and indentations are used for processing the speed and position of the elevator car.

7. The elevator system of claim 5, wherein the elevator component is an elevator car door, the optical sensor is operatively coupled to the elevator car door in such a manner to align with the object on an elevator door track such that as the optical sensor emits the signal onto the elevator door track as the elevator door opens and closes, the reflected signal off of the elevator door track is used to process the speed and position of the elevator door.

8. The elevator system of claim 5, wherein the optical sensor is operatively coupled to the elevator car, the object is a level marker associated to each landing level within the hoistway, and the surface features are lines identifying each landing level, such that as the elevator car moves, and the optical sensor emits a signal onto the level marker, the reflected signal off the lines are used for processing the speed and position of the elevator car and for identifying each landing level.

9. The elevator system of claim 8, wherein the lines identifying each landing level comprise at least one of bar code markings, numbers, and optically detectable lines.

10. An elevator system with a speed and position detection system, comprising:

an elevator car to travel within a hoistway having a width;

an optical sensor operatively coupled to the elevator car, and capable of emitting a signal and receiving a reflected signal of the emitted signal;

a static object associated with the optical sensor in such a manner to be aligned in a path of the optical sensor and having surface features; and a processor operatively coupled to the optical sensor and capable of processing the reflected signal to provide an output indicative of a speed and position of the elevator car, the processor using a time delay between emitting the signal and receiving the reflected signal and an angle between the signal and the reflected signal to determine the speed and position of the elevator component.

11. The elevator system of claim 10, wherein the static object is a rail extending within a hoistway and the surface features are protrusions and indentations on the rail.

12. The elevator system of claim 11, wherein the optical sensor emits the signal onto the rail and receives the reflected signal off the protrusions and indentations for processing the speed and position of the elevator car.

13. The elevator system of claim 10, wherein the static object is a level marker associated to each landing level within a hoistway, and the surface features are lines identifying each landing level.

14. The elevator system of claim 13, wherein the lines identifying each landing level comprise at least one of bar code markings, numbers, and optically detectable lines.

15. The elevator system of claim 13, wherein the optical sensor emits the signal onto the level marker and receives the reflected signal off the lines for processing the speed and position of the elevator car and identifying the landing level.

16. The elevator system of claim 10, wherein the optical sensor comprises at least one of a light-emitting diode and a laser diode.

17. The elevator system of claim 10, wherein the optical sensor has a range of sensing that is between a few millimeters and the width of the hoistway.

18. A method for detecting speed and position of an elevator component, comprising:

providing an optical sensor capable of emitting and receiving signals;

providing an object aligned in a path of the optical sensor and capable of reflecting signals;

providing a processor operatively coupled to the optical sensor and capable of processing reflected signals received by the optical sensor;

emitting a signal from the optical sensor onto the object;

receiving a reflected signal off the object; processing the reflected signal received by the optical sensor; and providing an output indicative of a speed and position of the elevator component, the processor using a time delay between emitting the signal and receiving the reflected signal and an angle between the signal and the reflected signal to determine the speed and position of the elevator component.

* * * * *